US007245867B2

(12) United States Patent
Baek et al.

(10) Patent No.: US 7,245,867 B2
(45) Date of Patent: Jul. 17, 2007

(54) WASTE TONER COLLECTING APPARATUS AND ELECTROPHOTOGRAPHIC IMAGE FORMING DEVICE INCLUDING THE SAME

(75) Inventors: Chung-guk Baek, Suwon-si (KR); Dong-hoon Park, Osan-si (KR); Jun-ho Lee, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/128,287

(22) Filed: May 13, 2005

(65) Prior Publication Data

US 2006/0018691 A1 Jan. 26, 2006

(30) Foreign Application Priority Data

Jul. 20, 2004 (KR) ..... 10-2004-0056424

(51) Int. Cl.
*G03G 21/10* (2006.01)

(52) U.S. Cl. ..... 399/358

(58) Field of Classification Search ..... 399/358, 399/343, 349, 350
See application file for complete search history.

(56) References Cited

FOREIGN PATENT DOCUMENTS

| | | |
|---|---|---|
| JP | 55124172 A * | 9/1980 |
| JP | 11-223977 | 8/1999 |
| JP | 2000-155457 | 6/2000 |
| JP | 2003-248401 | 9/2003 |
| JP | 2003307988 A * | 10/2003 |
| KR | 87-17055 | 11/1987 |
| KR | 88-12979 | 8/1988 |
| KR | 88-12987 | 8/1988 |
| KR | 1020030017913 | 3/2003 |

* cited by examiner

*Primary Examiner*—Susan Lee
(74) *Attorney, Agent, or Firm*—Roylance, Abrams, Berdo & Goodman, L.L.P.

(57) ABSTRACT

A waste toner collecting apparatus separates waste toner remaining on an outer circumferential surface of a photosensitive medium when a visible image is transferred thereon and stores the separated waste toner. An electrophotographic image forming device includes the waste toner collecting apparatus. The waste toner collecting apparatus includes a cleaning blade that separates the waste toner from a photosensitive medium by scratching the outer circumferential surface of the photosensitive medium. A waste toner container stores the waste toner. The waste toner separated from the photosensitive medium is transported to the waste toner container through a waste toner passage. An agitating plate reciprocates inside the waste toner passage to prevent accumulation of the waste toner.

6 Claims, 7 Drawing Sheets

WASTE TONER COLLECTING APPARATUS AND ELECTROPHOTOGRAPHIC IMAGE FORMING DEVICE INCLUDING THE SAME

BACKGROUND OF THE INVENTION

This application claims the benefit under 35 U.S.C. § 119(a) of Korean Patent Application No. 10-2004-0056424, filed on Jul. 20, 2004, in the Korean Intellectual Property Office, the entire disclosure of which is hereby incorporated by reference.

FIELD OF THE INVENTION

The present invention relates to an electrophotographic image forming device. More particularly, the present invention relates to a waste toner collecting apparatus for separating waste toner from a photosensitive medium and for storing the separated waste toner, and an electrophotographic image forming device including the same.

DESCRIPTION OF THE RELATED ART

Generally, an electrophotographic image forming device, such as a laser printer, a digital copier and the like, is a printing apparatus that operates in the following manner. First, a light beam is scanned onto a photosensitive medium charged to a predetermined voltage. An electrostatic latent image is formed on an outer circumferential surface of the photosensitive medium. Next, the latent image is developed into a visible image using a developing agent, such as toner. Then, the visible image is transferred and fixed on a piece of paper. The electrophotographic image forming device includes a waste toner collecting apparatus for separating waste toner remaining on the photosensitive medium when the visible image is transferred onto the paper and for collecting the separated waste toner.

FIG. 1 is a sectional view of a developing unit including a conventional waste toner collecting apparatus.

Referring to FIG. 1, a housing 11 of a developing unit 10 includes a toner T that is a developing agent. A waste toner collecting apparatus is placed inside the housing 11. The waste toner collecting apparatus includes a cleaning blade 15, a supporting frame 17, and a waste toner container 20. The cleaning blade 15 contacts an outer circumferential surface of a photosensitive medium 13 and scratches waste toner W therefrom. The supporting frame 17 supports the cleaning blade 15. The waste toner container 20 collects the waste toner W separated from the outer circumferential surface of the photosensitive medium 13 by the cleaning blade 15. An inner surface of the housing 11, the cleaning blade 15, and the supporting frame 17 constitute a waste toner passage through which the waste toner W separated from the photosensitive medium 13 is transported to the waste toner container 20.

However, in the conventional waste toner collecting apparatus, the waste toner W separated from the photosensitive medium 13 by the cleaning blade 15 can fail to slide along the waste toner passage and accumulates on the cleaning blade 15. As a result, movement of the waste toner W can be hindered. Furthermore, the waste toner passage can be clogged by the accumulated waste toner W. Accordingly, when the waste toner W accumulates on the cleaning blade 15 next to the photosensitive medium 13, the photosensitive medium 13 cannot rotate smoothly and the outer circumferential thereof is contaminated, thus resulting in low quality of a printing image.

Accordingly, a need exists for an improved waste toner collecting apparatus that eliminates accumulation of waste toner proximal the cleaning blade and photosensitive medium of an electrophotographic image forming device.

SUMMARY OF THE INVENTION

The present invention relates to a waste toner collecting apparatus including a unit that moves repeatedly inside a waste toner passage to prevent accumulation of waste toner therein, and an electrophotographic image forming device including the same.

According to an aspect of the present invention, a waste toner collecting apparatus includes a cleaning blade that separates waste toner remaining on an outer circumferential surface of a photosensitive medium when a visible image is transferred thereto. A waste toner container stores the waste toner. Waste toner separated from the photosensitive medium is transported to the waste toner container through a waste toner passage. An agitating plate reciprocates inside the waste toner passage to prevent accumulation of the waste toner.

The agitating plate may be connected to a shaft extending in a lengthwise direction of the photosensitive medium and reciprocating in the same direction. A sheet may be fixed to the shaft.

The waste toner collecting apparatus may include a cam having a slope that rotates in contact with an end of the shaft. An elastic member, such as a spring, elastically presses the shaft toward the cam, and the shaft reciprocates in a lengthwise direction of the photosensitive medium according to a rotation of the cam.

The sheet may have pores through which the waste toner may easily pass.

The agitating plate may be connected to a shaft extending in a lengthwise direction of the photosensitive medium and rotating by predetermined angles in alternating directions. A sheet may be fixed to the shaft.

In the waste toner collecting apparatus, an end of the shaft is a fixed end that cannot rotate. The other end of the shaft is a free end that is rotatable so that the rotated free end may be restored to an original position by an elastic force. The free end is rotated by predetermined angles in alternating directions by an external force.

The free end of the shaft may have a protrusion forward of an outer circumferential surface thereof. A rotor may have a pusher protruding from an outer circumferential surface thereof. The pusher may press the protrusion when the rotor rotates, thereby rotating the free end of the shaft.

The sheet may have pores through which the waste toner may easily pass.

According to another aspect of the present invention, an electrophotographic image forming device includes a photosensitive medium having an outer circumferential surface thereof on which a visible image is formed by a toner. A waste toner collecting apparatus separates waste toner remaining on a photosensitive medium when a visible image is transferred thereto and collects the separated waste toner. The waste toner collecting apparatus includes a cleaning blade that scratches the photosensitive medium to separate the waste toner remaining on an outer circumferential surface of the photosensitive medium when a visible image is transferred thereto. A waste toner container stores the waste toner. Waste toner separated from the photosensitive medium is transported to the waste toner container through a waste toner passage. An agitating plate reciprocates inside the waste toner passage to prevent accumulation of the waste toner therein.

The agitating plate of the waste toner collecting apparatus may include a shaft extending in a lengthwise direction of the photosensitive medium and that reciprocates in substantially the same direction. A sheet may be fixed to the shaft.

The waste toner collecting apparatus may include a cam having a slope that rotates in contact with an end of the shaft. An elastic member, such as a spring, elastically presses the shaft toward the cam. The shaft reciprocates in a lengthwise direction of the photosensitive medium according to the rotation of the cam.

The sheet of the waste toner collecting apparatus may have pores through which the waste toner may easily pass.

The agitating plate of the waste toner collecting apparatus may have a shaft extending in a lengthwise direction of the photosensitive medium and that rotates by predetermined angles in alternating directions. A sheet may be fixed to the shaft.

In the waste toner collecting apparatus, an end of the shaft may be a fixed end that cannot rotate. The other end of the shaft may be a free end that is rotatable so that the free end may be restored to an original position by an elastic force. The free end of the shaft is rotated by predetermined angles in alternating directions by an external force.

The waste toner collecting apparatus may further include a protrusion formed on an outer circumferential surface of the free end of the shaft. A pusher protrudes from an outer circumferential surface of a rotor. The pusher presses the protrusion when the rotor rotates, thereby rotating the free end of the shaft.

The sheet of the waste toner collecting apparatus may have pores through which the waste toner may easily pass.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Hereinafter, a waste toner collecting apparatus according to exemplary embodiments of the present invention and an electrophotographic image forming device including the same will be described in detail with reference to the attached drawings.

Figure 1:
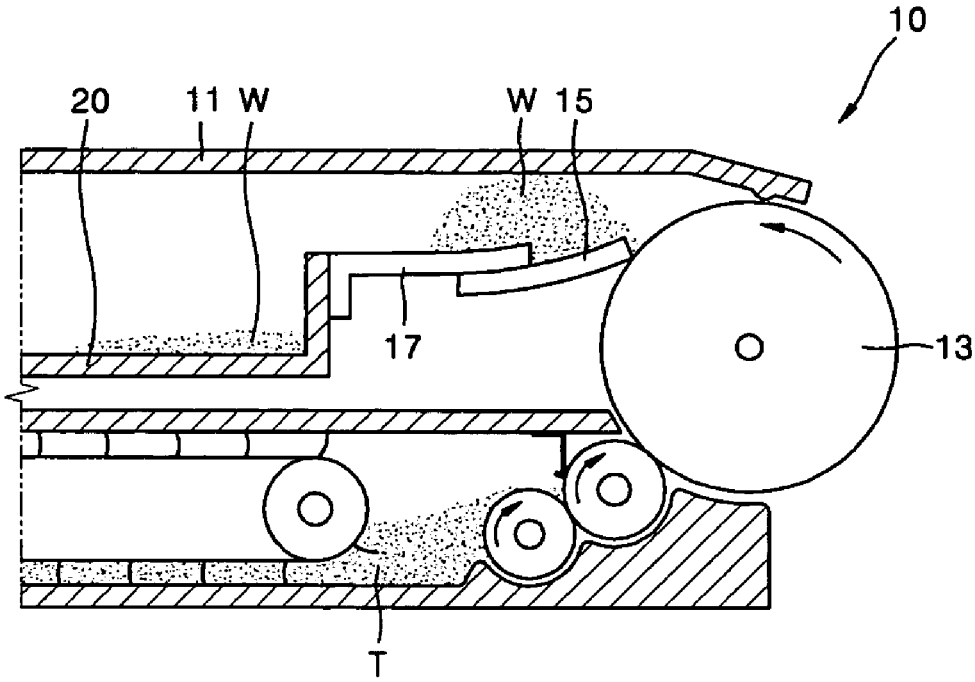
FIG. 1 (PRIOR ART)
FIG. 1 is an elevational view in partial cross section of a developing unit including a conventional waste toner collecting apparatus.
Figure 2:
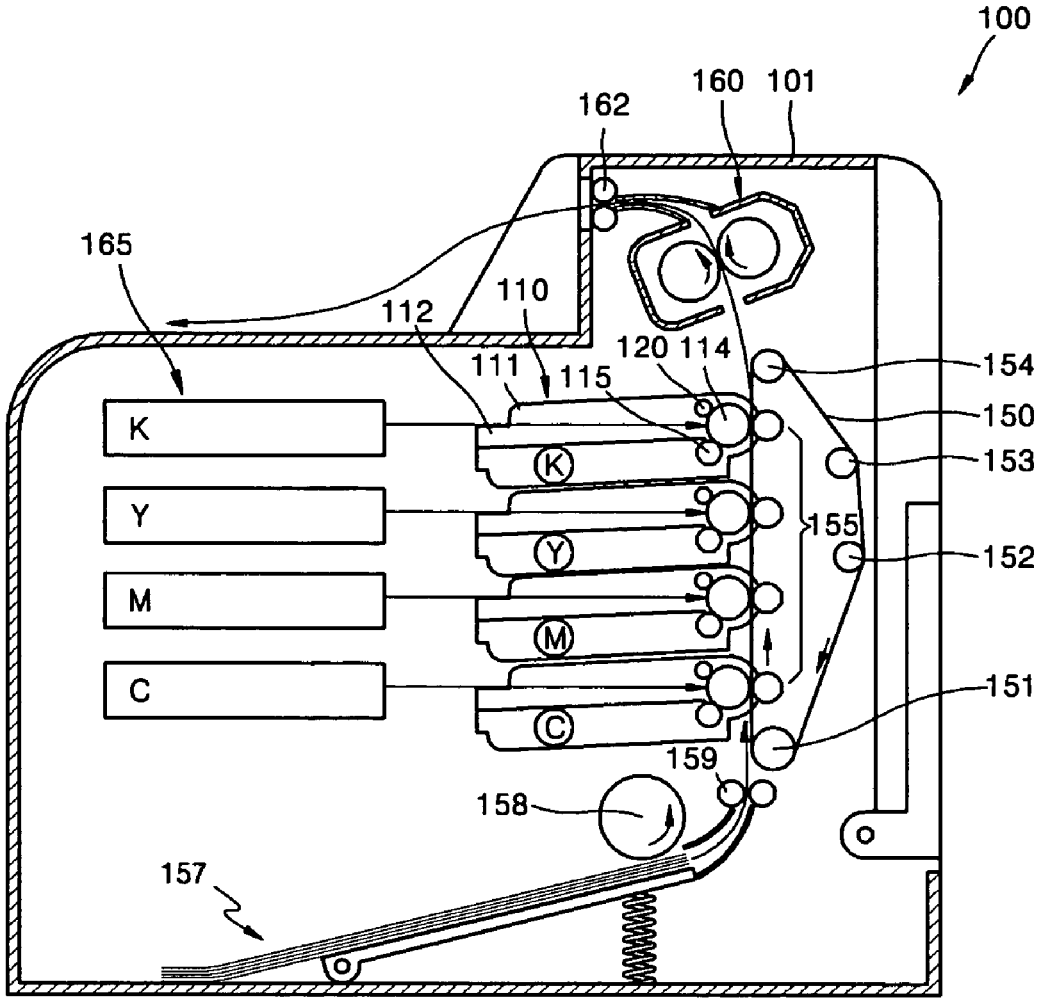
FIG. 2 is an elevational view in partial cross section of an electrophotographic image forming device according to an exemplary embodiment of the present invention.
Figure 3:
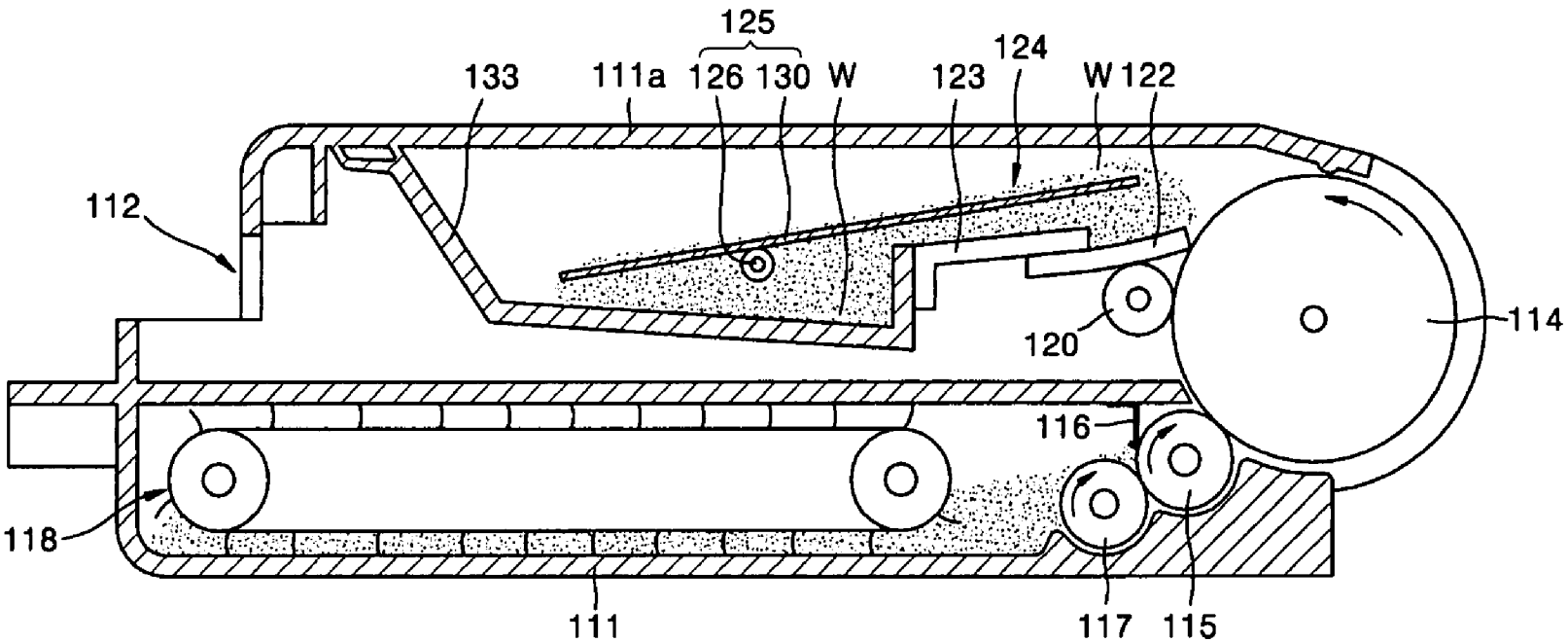
FIG. 3 is an elevational view in partial cross section of a developing unit including a waste toner collecting apparatus according to an exemplary embodiment of the present invention.
Figure 4:
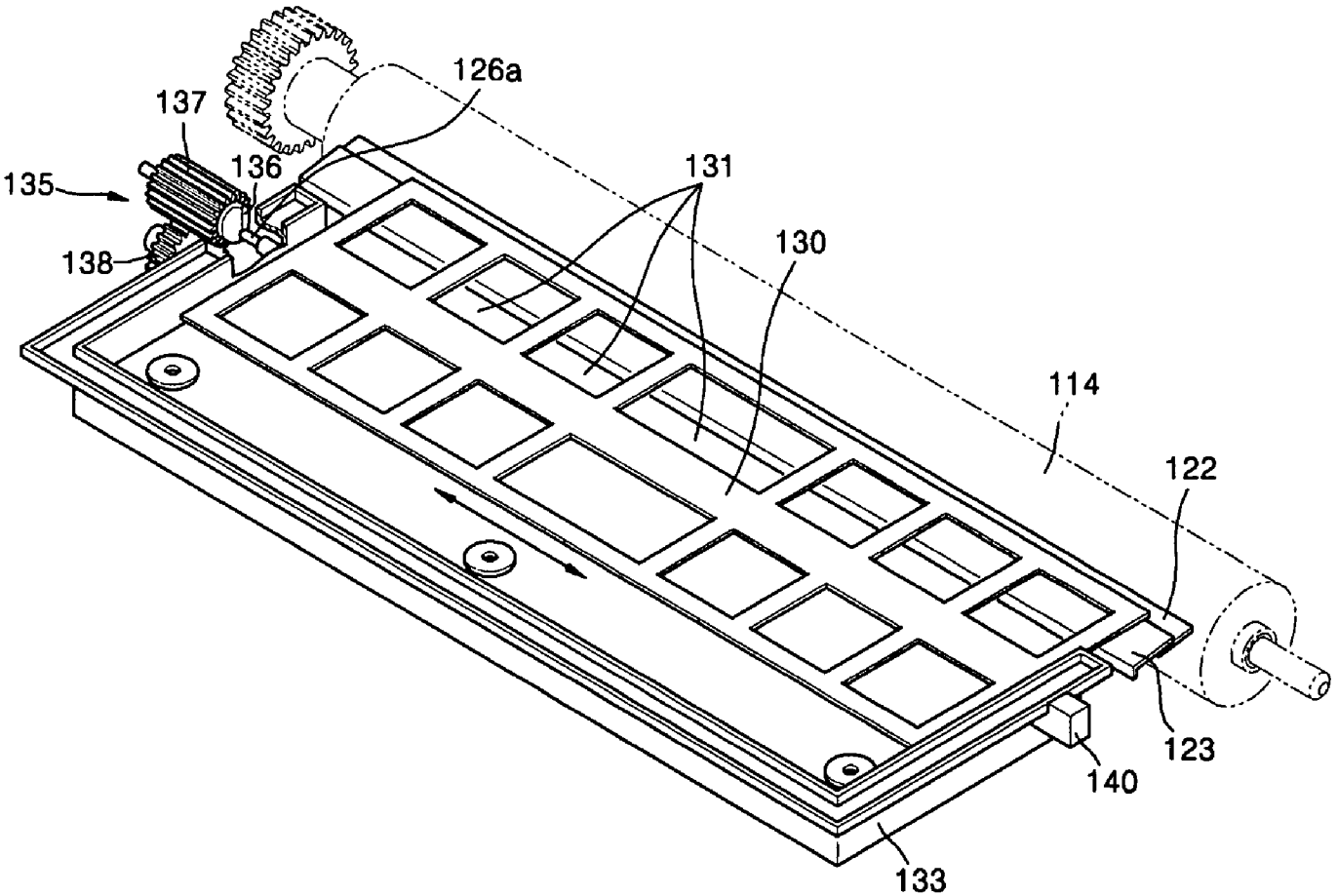
FIGS. 4 and 5 are a perspective view and an elevational view in partial cross section of the waste toner collecting apparatus in the developing unit of FIG. 3.
Figure 5:
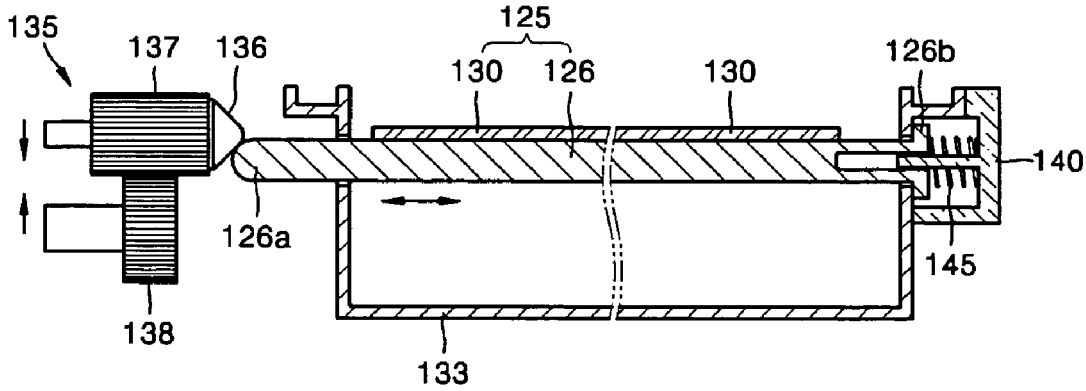

FIG. 2 is an elevational view in partial cross section of an electrophotographic image forming device according to an exemplary embodiment of the present invention. FIG. 3 is an elevational view in partial cross section of a developing unit including a waste toner collecting apparatus according to a first embodiment of the present invention. FIGS. 4 and 5 are a perspective view and an elevational view in partial cross section of the waste toner collecting apparatus inside the developing unit of FIG. 3.

Referring to FIG. 2, an electrophotographic image forming device 100 includes a case 101, a developing unit 110, a light scanning unit 165, a transfer belt 150, transfer rollers 155, a fixing unit 160, a cassette 157 adapted to store paper, a pickup roller 158 to pick up a piece of paper from the cassette 157, a transport roller 159 transporting the picked up paper, and a discharging roller 162 to discharge a piece of paper on which an image is printed to the outside of the case 101.

The developing unit 110 is a cartridge-type unit that allows a developing agent, such as toner, stored therein to be refilled. In the embodiment illustrated in FIG. 2, toners of various colors may be used to print a color image. For example, FIG. 2 shows four developing units 110C, 110M, 110Y, and 110K respectively storing cyan toner (C), magenta toner (M), yellow toner (Y), and black toner (K).

The transfer belt 150 is supported by a plurality of supporting rollers 151 through 154 that move the transfer belt 150 in one direction as indicated by the arrows of FIG. 2. According to the present embodiment, four light scanning units 165 are prepared corresponding to the four developing units 110C, 110M, 110Y, and 110K. Light scanning units 165C, 165M, 165Y, and 165K respectively scan a light beam corresponding to a C, M, Y, and B color image to a photosensitive medium 114 placed in a housing 111 of each of the developing units 110C, 110M, 110Y, and 110K. The light scanning units 165C, 165M, 165Y, and 165K may be a laser scanning unit (LSU) in which a laser diode is used as a light source.

Each of the developing units 110C, 110M, 110Y, and 110K includes the photosensitive medium 114 and a developing roller 115 in the housing. An outer circumferential surface of the photosensitive medium 114 is partly exposed to an outside of the housing 111. The developing units 110C, 110M, 110Y, and 110K each have a charging roller 120. The charging roller 120 may charge the outer circumferential surface of the photosensitive medium 114 to a uniform electric potential with a charge bias. The charging roller 120 may be replaced with a corona discharger. Thus, a toner is supplied to the photosensitive medium 114 by the developing roller 115. The developing roller 115 is charged with a developing bias to provide the toner to the photosensitive medium 114. Additionally, as shown in FIG. 3, the developing units 110C, 110M, 110Y, and 110K further include a supplying roller 117 providing the toner to the developing roller 115, a doctor blade 116 controlling the amount of the toner attached to the developing roller 115, and a conveyer belt-type mixer 118 transporting toner from the housing 111 to the supplying roller 117 in the housing. Each of the developing units 110C, 110M, 110Y, and 110K has an aperture 112 through which a light beam scanned by the light scanning units 165C, 165M, 165Y, and 165K may be irradiated to the photosensitive medium 114. An exposed portion of the outer circumferential surface of the photosensitive medium 114 faces the transfer belt 150.

The four transfer rollers 155 are positioned inside the loop of the receiving belt 150 to face the photosensitive medium 114 of each of the developing units 110C, 110M, 110Y, and 110K. The transfer roller 155 is charged with a transfer bias.

A color image forming process is as follows. The photosensitive medium 114 of each of the developing unit 110C, 110M, 110Y, and 110K is charged by the charge bias applied to the charging roller 120, which is a uniform electric charge. The light scanning units 165C, 165M, 165Y, and 165K respectively scan a light beam corresponding to a cyan, magenta, yellow, and black color image to the photosensitive medium 114 of each of the developing units 110C, 110M, 110Y, and 110K through the aperture 112. As a result, a latent image is formed on the outer circumferential surface of the photosensitive medium 114. The developing roller 115 is charged with the developing bias. Then, toner of a predetermined color is transported from the developing roller 115 to the outer circumferential surface of the photosensitive medium 114. As a result, visible images including cyan, magenta, yellow, and black are developed on the outer circumferential surface of the photosensitive medium 114 of each of developing units 110C, 110M, 110Y, and 110K, respectively.

Meanwhile, a piece of paper is picked up from the cassette 157 by the pickup roller 158, and sent to the transport belt 150 by the transport roller 159. The paper is affixed to a surface of the transfer belt 150 by electrostatic force, and transported at a linear velocity substantially equivalent to that at which the transfer belt 150 is moving.

A front end of the paper transported while being affixed to the transfer belt 150 reaches a transfer nip when a front end of a visible cyan image formed on the outer circumferential surface of the photosensitive medium 114 of the developing unit 110C reaches a transfer nip facing the transfer roller 155. At this moment, the transfer roller 155 is charged with the transfer bias, so that the visible image formed on the photosensitive medium 114 may be transferred to the paper. Then, while the paper is continually transported, visible magenta, yellow, and black images formed on the outer circumferential surface of the photosensitive medium 114 of the developing units 110M, 110Y, and 110K are sequentially transferred on the paper and overlapped to form a color visible image on the paper. The fixing unit 160 fixes the color visible image on the paper using heat and pressure. After the fixing process is completed, the paper is discharged outside of the case 101 by the discharging roller 162.

The developing units 110C, 110M, 110Y, and 110K each includes a waste toner collecting apparatus. When the color visible image is transferred, waste toner remains on the outer circumferential surface of the photosensitive medium 114. The waste toner collecting apparatus separates the remaining waste toner from the photosensitive medium 114, and collects the separated waste toner. Hereinafter, a waste toner collecting apparatus included in each of the developing units 110C, 110M, 110Y, and 110K is described with reference to FIGS. 3 through 5.

The waste toner collecting apparatus includes a cleaning blade 122, a waste toner container 133, a waste toner passage 124, and an agitating plate 125. The cleaning blade 122 scratches waste toner W from an outer circumferential surface of a photosensitive medium 114. The waste toner W is stored in the waste toner container 133. The waste toner W separated from the photosensitive medium 114 is transported to the waste toner container 133 via the waste toner passage 124. The agitating plate 125 reciprocates inside the waste toner passage 124 to prevent accumulation of the waste toner W therein.

The cleaning blade 122 is fixedly supported by a supporting frame 123. An end of the cleaning blade 122 contacts an outer circumferential surface of the photosensitive medium 114. The supporting frame 123 is fixed to the waste toner container 133. The waste toner passage 124 is defined by the cleaning blade 122, the supporting frame 123, and an upper portion 111*a* of the housing 111.

The agitating plate 125 includes a shaft 126 extending in a lengthwise direction of the photosensitive medium 114 and a sheet 130 fixed to the shaft 126. The sheet 130 has pores 131 through which the waste toner W may pass. First and second ends 126*b* and 126*a* of the shaft 126 pass through two side walls of the waste toner container 133, respectively, so that the shaft 126 may be installed therethrough.

The second end 126*a* of the shaft 126 protruding by passing through the waste toner container 133 contacts a slope 136 of a cam 135. An outer circumferential surface 137 of the cam 135 has gear teeth cut therein. A gear surface 137 is coupled to a cam driving gear 138, which is in turn coupled to a developing roller driving gear (not shown) that rotates the developing roller 115. As a result, when an image forming process is initiated, the cam 135 rotates by the rotation of the development roller 115.

The shaft 126 is elastically pressed toward the cam 135 by an elastic member, such as a spring 145, that contacts the first end 126*b* of the shaft 126. The spring 145 is supported by a bracket 140, which is fixed to the waste toner container 133.

When an image forming process is initiated in the electrophotographic image forming device 100, the developing roller 115 and the photosensitive medium 114 rotate, and the waste toner W is separated from the outer circumferential surface of the photosensitive medium 114 by the cleaning blade 122. Then, the separated waste toner W enters into the waste toner passage 124. The cam 135 rotates by the rotation of the developing roller 115. As a result, the slope 136 presses the shaft 126 toward the spring 145. Thus, the shaft 126 and the sheet 130 fixed to the shaft 126 reciprocate in a lengthwise direction of the photosensitive medium 114. Therefore, the waste toner W in the waste toner passage 124 is shaken by the agitating plate 125. As a result, the waste toner W does not substantially accumulate in the waste toner passage 124 and is continually transported along the waste toner passage 124 to be accumulated in the waste toner container 133.

Figure 6:
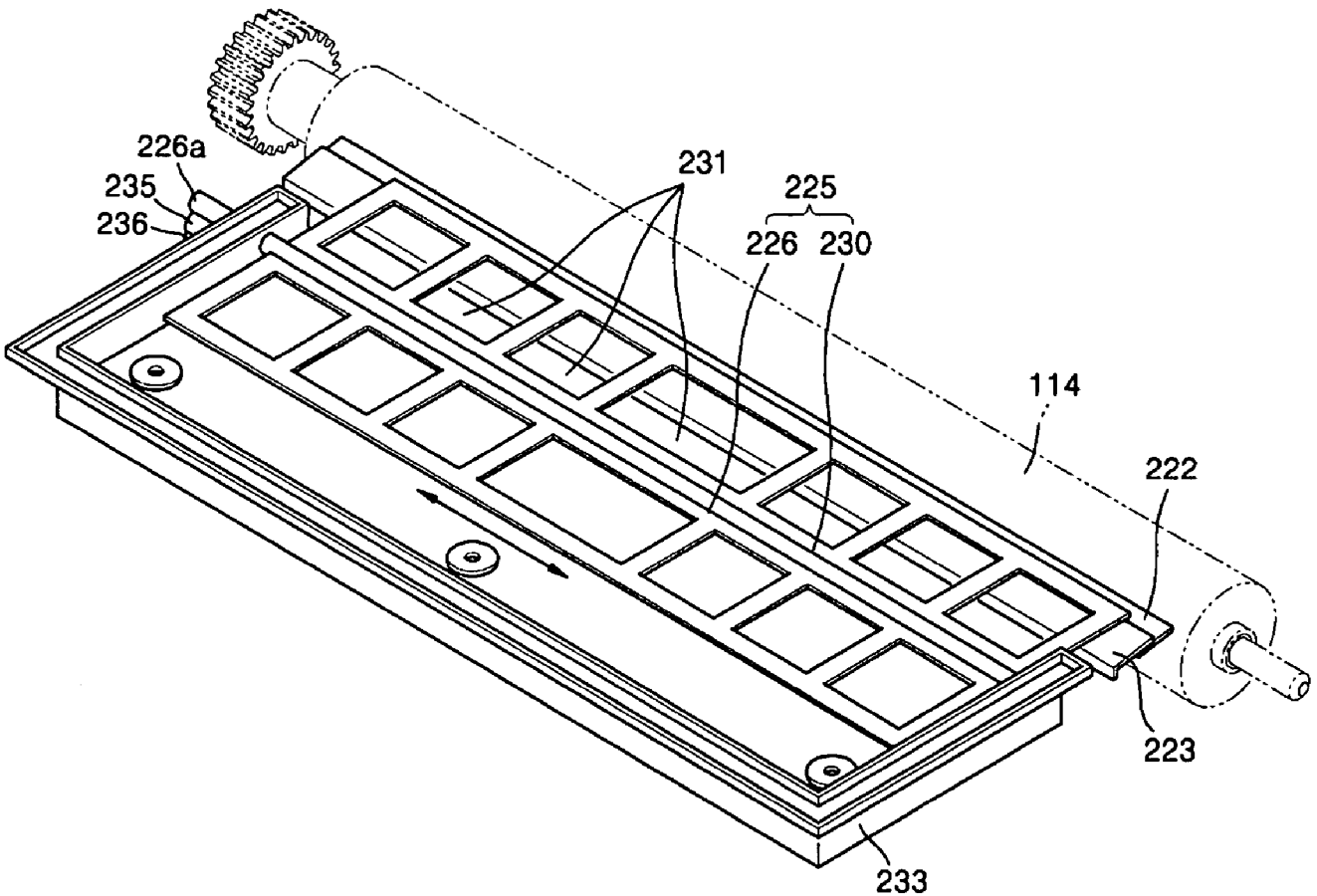
FIGS. 6 and 7 are a perspective view and an elevational view in partial cross section of a waste toner collecting apparatus according to another exemplary embodiment of the present invention.
Figure 7:
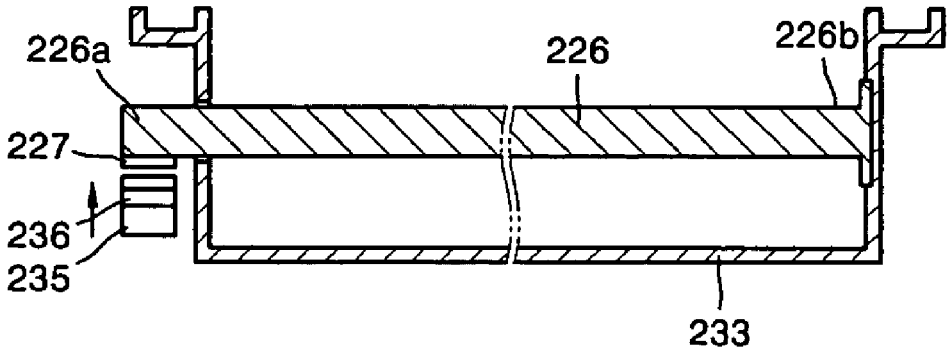
Figure 8:
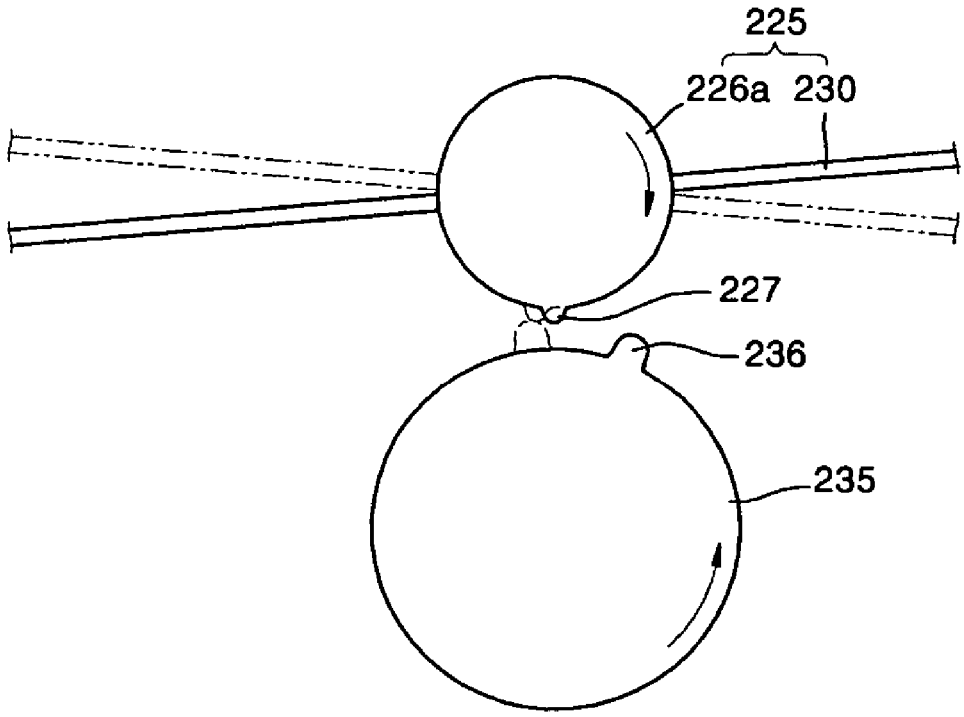
FIG. 8 is an elevational view illustrating a structure spurring an agitating plate of the waste toner collecting apparatus of FIGS. 6 and 7 to rotate by predetermined angles in alternating directions.

FIGS. 6 and 7 are a perspective view and a sectional view in partial cross section of a waste toner collecting apparatus according to a second embodiment of the present invention. FIG. 8 is an elevational view illustrating a structure spurring an agitating plate of the waste toner collecting apparatus to rotate by predetermined angles in alternating directions.

Hereinafter, a waste toner collecting apparatus according to a second embodiment of the present invention is described with reference to FIGS. 6 through 8. The waste toner collecting apparatus according to a second exemplary embodiment includes a cleaning blade 222, a waste toner container 233, a waste toner passage, and an agitating plate 225. The cleaning blade 222 scratches waste toner W remaining on a photosensitive medium 114 while contacting an outer circumferential surface of the photosensitive medium 114. As a result, the waste toner W is separated from the photosensitive medium 114. The separated waste toner W is stored in the waste toner container 233. The waste toner passage is defined by the cleaning blade 222, a supporting frame 223, and a developing unit housing (not shown). The agitating plate 225 rotates inside the waste toner passage to prevent accumulation of the waste toner W.

The agitating plate 225 includes a shaft 226 extending in a lengthwise direction of the photosensitive medium 114, and a sheet 230 fixed to the shaft 226. The sheet 130 has pores 231 through which the waste toner W may pass. A second end 226*a* of the shaft 226 is a free end that passes through one sidewall of the waste toner container 233. Thus, the end 226*a* is supported by the waste toner container 233 and is rotatable therein. A first end 226*b* of the shaft 226 is a fixed end. The first end 226*b* of the shaft 126 is fixed in an inner surface of the other sidewall of the waste toner container 233 and cannot rotate. The shaft 226 is preferably composed of a metal, such as spring steel. Thus, even when the free end 226*a* rotates by predetermined degrees by an external force, once the external force is removed, the free end 226*a* is restored to its original position.

The free end 226*a* of the shaft 226 has a protrusion 227 protruding from an outer circumferential surface of the free end 226*a*. A rotor 235 is positioned outside the waste toner container 233. The rotor 235 has a pusher 236 protruding from an outer circumferential surface. The rotor 235 is coupled to a developing roller driving gear (not shown) providing a torque to a developing roller (115 in FIG. 2). Accordingly, when an image forming process is initiated, as shown in FIG. 8, the rotor 235 rotates and the pusher 236 presses the protrusion 227. Therefore, the free end 226*a* of the shaft 226 rotates by a predetermined angle in a clockwise direction. When the rotor 235 rotates by a large angle, the pusher 236 contacts and then passes by the protrusion 227. In this case, the free end 226*a* rotates counterclockwise by an elastic restoring force, thus moving back to its original position. As described above, the shaft 226 periodically rotates by predetermined angles in alternating directions. Therefore, the sheet 230 fixed to the shaft 226 also periodically rotates by predetermined angles in alternating directions. Due to this rotation, waste toner separated from the photosensitive medium 114 by the cleaning blade 222 is pushed by the sheet 230 and continually moves toward the waste toner container 233. Therefore, the waste toner does not substantially accumulate in the waste toner passage.

The waste toner collecting apparatus according to exemplary embodiments of the present invention and the electrophotographic image forming device including the same have several advantages. The agitating plate suppresses accumulation of waste toner. The photosensitive medium rotates smoothly due to the absence of toner accumulation. The outer circumferential surface of the photosensitive medium is protected from contamination due to the absence of toner accumuluation. As a result, printed images are of high quality.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A waste toner collecting apparatus, comprising:

a cleaning blade contacting a photosensitive medium to remove waste toner remaining on an outer circumferential surface of the photosensitive medium when a visible image is transferred thereon, the cleaning blade being of a fixed type;

a waste toner container in which the waste toner is stored;

a waste toner passage through which the waste toner separated from the photosensitive medium is transported to the waste toner container; and an agitating plate reciprocating inside the waste toner passage to prevent accumulation of the waste toner therein, the agitating plate including a shaft extending in a lengthwise direction of the photosensitive medium and reciprocating in the same direction and a sheet fixed to the shaft, the sheet having pores through which the waste toner passes.

2. The waste toner collecting apparatus of claim 1, wherein a cam having a slope rotates in contact with an end of the shaft; and an elastic member elastically presses the shaft toward the cam, the shaft reciprocates in the lengthwise direction of the photosensitive direction according to a rotation of the cam.

3. The waste toner collecting apparatus of claim 2, wherein the elastic member is a spring.

4. An electrophotographic image forming device, comprising:

a photosensitive medium having an outer circumferential surface thereof on which a visible image is formed by a toner, and a waste toner collecting apparatus separating waste toner remaining on the photosensitive medium therefrom, and collecting the separated waste toner, the waste toner collecting apparatus including a cleaning blade contacting the photosensitive medium to remove the waste toner remaining on an outer circumferential surface of the photosensitive medium when a visible image is transferred thereon, the cleaning blade being of a fixed type;

a waste toner container in which the waste toner is stored;

a waste toner passage through which the waste toner separated from the photosensitive medium is transported to the waste toner container; and an agitating plate reciprocating inside the waste toner passage to prevent accumulation of the waste toner therein, the agitating plate including a shaft extending in a lengthwise direction of the photosensitive medium and reciprocating in the same direction and a sheet fixed to the shaft, the sheet of the waste toner collecting apparatus having pores through which the waste toner passes.

5. The electrophotographic image forming device of claim 4, wherein the waste toner collecting apparatus has a cam having a slope rotating in contact with an end of the shaft, and an elastic member elastically pressing the shaft toward the cam, the shaft reciprocates in a lengthwise direction of the photosensitive medium according to a rotation of the cam.

6. The electrophotographic image forming device of claim 5, wherein the elastic member is a spring.

* * * * *